US005428878A

United States Patent [19]

Mueller

[11] Patent Number: 5,428,878

[45] Date of Patent: Jul. 4, 1995

[54] THREAD OR YARN MONITOR FOR TEXTILE MACHINES

[75] Inventor: Peter Mueller, Wies, Switzerland

[73] Assignee: Zellweger Luwa AG, Uster, Switzerland

[21] Appl. No.: 229,122

[22] Filed: Apr. 18, 1994

Related U.S. Application Data

[63] Continuation of Ser. No. 818,862, Jan. 10, 1992, abandoned.

[30] Foreign Application Priority Data

Jan. 10, 1991 [CH] Switzerland ..... 00052/91

[51] Int. Cl.[6] ..... B65H 63/00; D03D 51/28

[52] U.S. Cl. ..... 28/185; 28/189; 139/354

[58] Field of Search ..... 28/173, 185, 186, 187, 28/188, 189, 241, 242; 226/45; 242/36, 37 R; 73/159, 160, DIG. 4; 139/353, 354, 361, 368

[56] References Cited

U.S. PATENT DOCUMENTS

| | | | |
|---|---|---|---|
| 2,763,035 | 9/1956 | Mackie | 28/189 |
| 4,117,870 | 10/1978 | Gotoh | 139/370.2 |
| 4,229,628 | 10/1980 | Bogucki | 28/186 |
| 4,551,591 | 11/1985 | Jones | 28/187 |
| 4,710,646 | 12/1987 | Curda et al. | 28/188 |

FOREIGN PATENT DOCUMENTS

| | | | |
|---|---|---|---|
| 884479 | 7/1949 | Germany | 28/187 |
| 354640 | 11/1937 | Italy | 28/187 |
| 2059594 | 4/1981 | United Kingdom . | |

OTHER PUBLICATIONS

European Search Report for counterpart European Application 0 495 229 A1.

Summary Sheet for WO 91/10003, published Jul. 11, 1991.

*Primary Examiner*—Clifford D. Crowder

*Assistant Examiner*—Larry D. Worrell, Jr.

*Attorney, Agent, or Firm*—Burns, Doane, Swecker & Mathis

[57] ABSTRACT

The thread monitor serves to detect the passage in a textile machine of a thread (F) moving in a direction transverse to the thread length. The monitor contains a pivoting member (B) which can be actuated by the thread and a sensor (7) monitoring the actuation of this pivoting member. The pivoting member (B) is designed in such a way that, during the passage of the thread, the pivoting member (B) is deflected from its rest position and then returned into its rest position, the sensor (7) being designed for detecting this return. The pivoting member (B) is elastic and in one-piece and the sensor (7) is sensitive to pressure. The monitor may be used in thread storage means and thread-transfer devices, particularly those in weaving and in warp-thread preparation apparatus.

11 Claims, 1 Drawing Sheet

THREAD OR YARN MONITOR FOR TEXTILE MACHINES

This application is a continuation of application Ser. No. 07/818,862, filed Jan. 10, 1992 now abandoned.

FIELD OF THE INVENTION

This invention relates to a thread monitor for detecting the passage by a certain position of a transversely moving thread or yarn in textile apparatus. It is concerned particularly with detector means responsive to the passage thereby of a loop or knee portion of a thread or yarn.

Thread monitors according to the invention can be used wherever a transverse movement of a thread takes place, which can be the case, for example, during transfer of a thread from one member to another or during removal of a thread from a supply. Examples for this are thread levers or multicolor changers for weaving machines, in particular for gripping weaving machines, or preparatory machines for weaving such as, for example, tying-in, splicing or drawing-in machines for warp threads.

BACKGROUND

International Application PCT/CH90/00283 (U.S. Pat. Ser. No. 07/741,531) now U. S. Pat. No. 5429339 discloses a warp-thread drawing-in machine in which the thread layer is clamped on a frame, and the individual warp threads are separated one after the other, offered to a drawing-in gripper and drawn by the latter into the harness. After being received by the drawing-in gripper, the vertically clamped warp thread, in loop form, passes a vertical thread channel at the beginning of which a thread monitor is arranged. The thread monitor checks during every draw-in whether a warp thread has actually been drawn in. It is made up of a flexible pivoted lever which can be displaced by the passing thread, and the displacement of the pivoted lever is monitored by an inductive sensor.

This thread monitor has proved successful in practice, but it still does not represent an optimum solution to the thread passage detection task. The pivoted lever is subject to a certain wear and stress. It is also not out of the question for the inductive sensor to function unreliably during heavy accumulation of dust. Since as high a reliability as possible is required of this thread monitor, its operation requires a certain amount of maintenance, which is always undesirable.

SUMMARY OF THE INVENTION

The present invention provides a new form of thread monitor. A shiftable member is positioned so that it will be shifted away from its rest position by a transversely moving thread portion (i.e. the bight of a thread loop) and will return to its initial position after passage of the thread. A sensor is provided for detecting this return.

This shiftable member is biassed toward its rest position. It may be a pivoting member designed in such a way that, during the passage of the thread, the pivoting member is deflected from its rest position and then returned into its rest position. However, it preferably is elastic and of one-piece design, and the sensor is designed to be sensitive to pressure exerted by the shiftable member upon its return.

A shiftable member can be used which is simple and inexpensive and whose operation is virtually maintenance-free. The pressure-sensitive sensor is only slightly susceptible to the accumulation of dust and dirt and functions exceptionally reliably. Consequently, a monitor according to the invention requires little maintenance, has no wear parts, functions reliably under a wide variety of ambient conditions and is cost-effective as well.

BRIEF DESCRIPTION OF THE DRAWINGS

The invention is described in greater detail below with reference to an exemplary embodiment shown in the drawings, in which.

DETAILED DESCRIPTION OF PREFERRED EMBODIMENT

Figure 2:
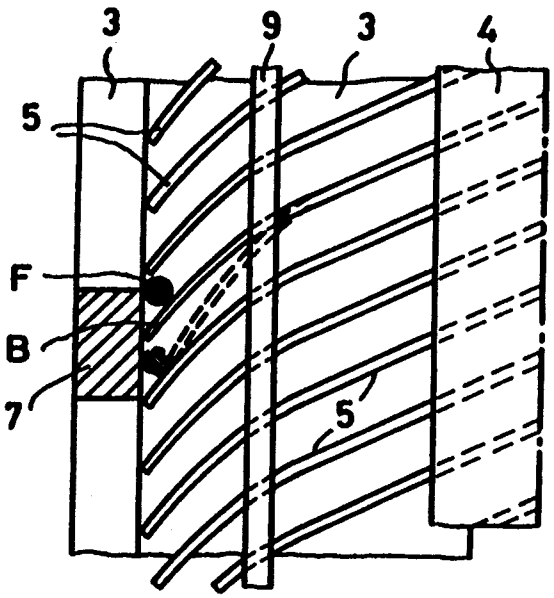
FIG. 2 shows a detail from FIG. 1 to a scale of 3:1.
Figure 1:
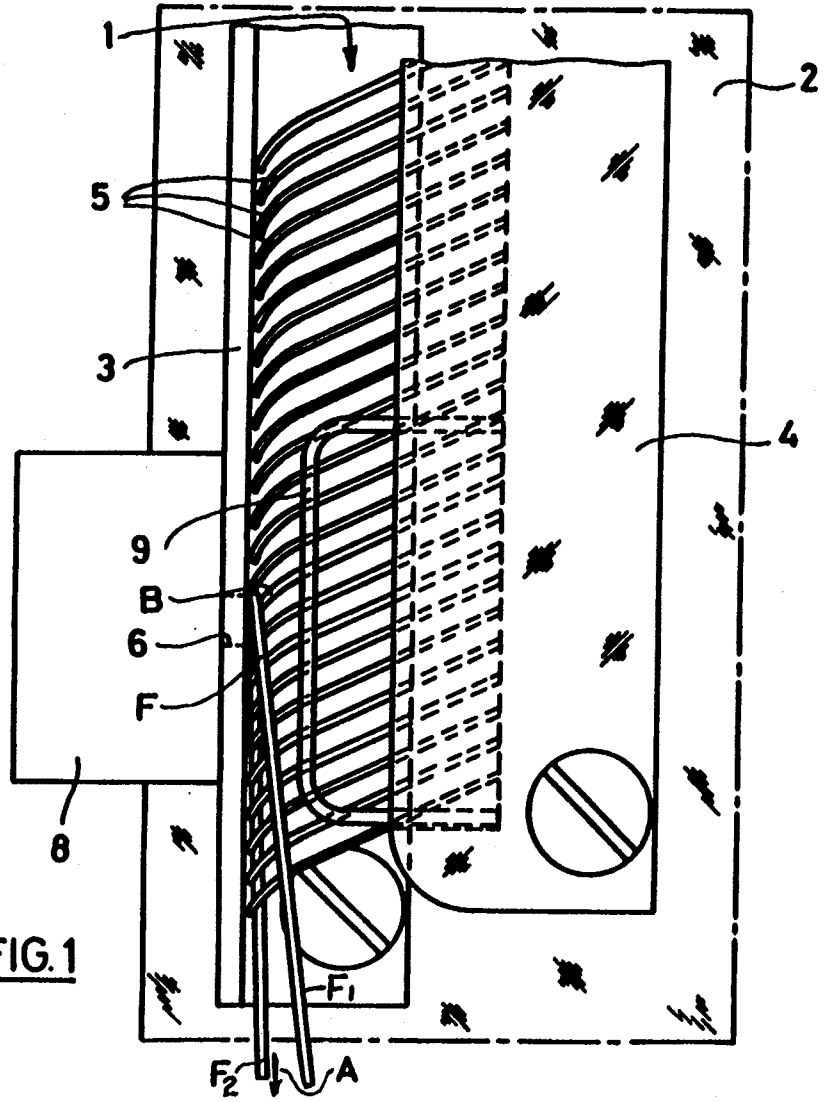
FIG. 1 shows, to a scale of 1.5:1, a portion of a thread-holding device having a thread monitor according to the invention.

The illustrated thread-holding device shown serves to release in a controlled manner a thread piece F, present in the form of a loop, when a force acts to pull the thread out of the thread-holding device. It comprises an elongated conveying channel 1 which contains the thread loop and thus performs the function of a thread storage means. The loop is fixed outside the conveying channel 1 at one leg $F_1$ in a stationery clamp and at its other leg $F_2$, that is, in the area of the free thread end, in a transport means which pulls the thread P out of the conveying channel 1 in the direction of arrow A. Such transport means may include a transport belt extending through a closed path a portion of which passes through the channel 1 from the top of FIG. 1 to the bottom of FIG. 1. A clamp means carried by the belt grips the end portion of the thread F and pulls the leg $F_2$ downwardly in FIG. 1 as the transport belt moves along its path. So that this pulling-out of the thread F can be effected in a controlled manner and the thread loop is retained to the very end, brake elements acting on the knee of the loop are provided in the conveying channel 1, which brake elements keep the thread taut. In FIG. 1 and 2, these brake elements are designated by the reference numeral 5.

The arrangement shown is a component of a warp thread drawing-in machine, as described, for example, in the International Application PCT/CH90/00283 of Zellweger Uster AG, corresponding to U.S. Pat. Ser. No. 07/741,531 now U.S. Pat. No. 5249339 the disclosure of which is incorporated herein by reference in its entirety. In this drawing-in machine, the warp-thread layer to be drawn in is clamped on a vertical frame which is positioned in front of the drawing-in machine and in front of its drawing-in member, which can be driven in an oscillating manner perpendicularly to the warp-thread layer. Allocated to the drawing-in member is a so-called thread-separating system, past which the clamped warp threads are moved and as a result are separated and selected. After the selecting, the warp threads are cut off and presented to the drawing-in member, the illustrated thread-holding device forming part of this thread-presenting system. The thread-presenting system is described in detail in Swiss Application No. 3619/90-1 of Zellweger Uster AG corresponding to International Application No. PCT/CH 91/00229, the disclosures of which are incorporated herein by reference.

The thread-holding device preferably has the form disclosed in U.S. application Ser. No. 07/739,475 filed Aug. 2, 1991, the disclosure of which is incorporated herein by reference. It includes the conveying channel 1 already mentioned, which is formed by two L-shaped rails 3 and 4 mounted on a base plate 2 and enclosing the shaft-like conveying channel 1. On the side remote from the base plate 2, a continuous slot is formed between the two rails 3 and 4, which slot is covered by elastic bristles 5 made of a suitable material, for example steel or a plastic such as nylon. The bristles 5 are preferably embedded in a carrying band which is adhesively bonded into a corresponding step on the inside of the right-hand rail 4 in FIG. 1 and they are longer than the width of the slot at their part overlapping the slot. With their free head part, the bristles butt against the left-hand rail 3, designated below as stop rail, and are bent over on the latter. This means that the bristles 5, with their head part, press flexibly against the stop rail 3. The several bristles 5 are contacted one after another by the thread loop being pulled out of the channel 1, with each of the bristles 5 acting as a brake element to control the release of the thread and keeping the thread taut as the thread is moved out of the channel.

Towards the discharge end of the conveying channel 1, the stop rail 3 has a window-like aperture 6 into which a piezoelectric sensor 7 is inserted whose wiring is located in a housing 8 connected to the stop rail 3 and/or to the base plate 2.

The mode of operation of the piezoelectric sensor is as follows: the thread loop F located in the conveying channel 1 is held by a bristle 5 at its knee, where the two legs of the loop meet, and jumps from one bristle to the next when being drawn out of the conveying channel 1, in the course of which the bristle 5 just holding the loop is pressed away downwards and as a result is additionally tensioned and, after passing the thread F, springs back into its initial position.

This situation is shown in FIG. 2, and in fact at the moment at which the thread F or, more precisely, the knee of the thread loop just reaches the piezoelectric sensor 7. The very next moment, the thread F strikes a bristle, designated by B, which, when the thread passes, is pivoted from the position drawn in solid lines into the position drawn in dotted lines (dotted position of thread). As soon as the thread has passed the bristle B, the latter pivots back out of its dotted position into the rest position and as a result strikes against piezoelectric sensor 7. This pressure impulse is detected by the sensor 7 and is interpreted in the signal processing means as a signal for the passage of a thread. Since the sensor 7 is arranged near the discharge opening of the thread loop from the conveying channel 1, that is, at a location where the thread loop is already very short and therefore the thread is already for the most part drawn into the harness, the signal from the sensor 7 is evaluated as confirmation of the completed drawing-in of the thread.

In order to ensure that the bristle B forming part of the thread monitor strikes the piezoelectric sensor 7 when pivoting back into the rest position and does not strike against the stop rail 3 next to this piezoelectric sensor 7, the bristles 5 are guided in the area of the sensor 7 between two stirrups 9 which are arranged on either side of the bristle group. In FIGS. 1 and 2, a frontmost stirrup 9, closest to the viewer, is visible and the bristles 5 are located behind this frontmost stirrup 9 as indicated by the broken line showing of the bristle portions that would otherwise not be visible because of the presence of this stirrup. The other, rearmost, stirrup 9, is aligned with the frontmost stirrup 9 so that it is not visible in FIGS. 1 and 2. This rearmost stirrup is located behind the bristles 5. Since the two stirrups 9 are located on opposite sides of the bristles 5, they inhibit lateral flexing of the bristles so that the bristles do not give way laterally.

Practical testing has shown that the thread monitor described functions absolutely reliably despite its simple construction. Particularly good results were obtained with spring steel bristles of 0.3 mm thickness and lengths 2 mm longer than the width of the slot formed between the two rails 3 and 4.

The description of the use of the thread monitor on a warp-thread drawing-in machine is not to be understood as a restriction in all instances. A thread monitor of this type can be used wherever the thread to be monitored performs a transverse movement.

What is claimed is:

1. An apparatus for monitoring an elongated thread having a portion which is movable along a path extending in a direction at an angle to the lengthwise dimension of said thread for detecting the movement of said thread portion along said path over a predetermined location in a textile machine, comprising a deflectable member biased toward a rest position in the path of movement of said thread portion, said deflectable member being deflected from and returned to said rest position during movement of said thread portion along said path, and pressure sensitive sensor means for determining movement of said thread portion over said predetermined location by detecting pressure applied by the deflectable member when the deflectable member returns to the rest position, said deflectable member being movable relative to said sensor means and being mounted in a position such that said sensor means is contacted by said deflectable member when said deflectable member returns to said rest position to detect the return of said member to said rest position after the movement of said thread portion over said predetermined location.

2. A thread monitor for detecting movement of a thread past a fixed point, said monitor having a deflectable member which is actuable by the movement of the thread, and a pressure sensitive sensor monitoring the actuation of said deflectable member by detecting pressure applied to the sensor by the deflectable member, wherein said deflectable member is flexible and of one-piece design so that, during the movement of the thread past said fixed point, the deflectable member is deflected relative to the sensor from a first position and then returned into said first position, and said sensor determining that the thread has moved past said fixed point by detecting pressure applied to the sensor by the deflectable member upon said return of said deflectable member to said first position.

3. A thread monitor according to claim 2, wherein said monitor includes a stop, said deflectable member having two ends and being arranged transversely to the thread, one of the ends of the deflectable member being anchored and the other end pressing against said stop.

4. A thread monitor according to claim 3, wherein said sensor is formed by a piezoelectric quartz crystal.

5. A thread monitor according to claim 4, wherein said monitor includes a stop, said deflectable member having two ends and being arranged transversely to the thread, one end of said deflectable member being anchored and the other end pressing against said stop, said stop being of planar design and having an opening therein into which said piezoelectric quartz crystal is inserted.

6. A thread monitor according to claim 3, wherein said deflectable member comprises a plastic bristle.

7. A thread monitor according to claim 3, wherein said deflectable member comprises a steel bristle.

8. A thread monitor according to claim 7, wherein said bristle has a diameter between about 0.15 and about 0.5 mm.

9. A thread monitor according to claim 8, wherein said diameter is about 0.3 min.

10. A thread monitor according to claim 3, wherein said deflectable member is positioned between two stirrups in a defined displacing plane to inhibit lateral flexing of the deflectable member.

11. A thread monitor according to claim 3, wherein said deflectable member is a bristle forming part of a row of uniform bristles arranged in a conveying channel for a loop-shaped thread, said bristles providing for a controlled release of the thread loop in the conveying channel.

* * * * *